US010697728B2

(12) United States Patent
Morrell

(10) Patent No.: US 10,697,728 B2
(45) Date of Patent: Jun. 30, 2020

(54) PEEP SIGHT FOR AN ARCHERY BOW

(71) Applicant: Dale A Morrell, Alma, AR (US)

(72) Inventor: Dale A Morrell, Alma, AR (US)

( * ) Notice: Subject to any disclaimer, the term of this patent is extended or adjusted under 35 U.S.C. 154(b) by 198 days.

(21) Appl. No.: 15/831,097

(22) Filed: Dec. 4, 2017

(65) Prior Publication Data

US 2018/0156565 A1 Jun. 7, 2018

Related U.S. Application Data

(60) Provisional application No. 62/430,481, filed on Dec. 6, 2016.

(51) Int. Cl.
*F41G 1/467* (2006.01)
*F41B 5/14* (2006.01)

(52) U.S. Cl.
CPC ..... *F41B 5/1419* (2013.01); *F41G 1/467* (2013.01)

(58) Field of Classification Search
CPC ..... F41B 5/1419; F41G 1/467
USPC ..... 33/265; 124/87
See application file for complete search history.

(56) References Cited

U.S. PATENT DOCUMENTS 2,093,676 A * 9/1937 Hennessy ..... F41G 1/24 42/136
2,102,677 A * 12/1937 Campbell ..... F41G 1/08 42/133
2,767,472 A * 10/1956 Kocur ..... F41G 1/467 33/265
3,666,368 A 5/1972 Sprandel
3,674,002 A * 7/1972 Diamond, Sr. ..... F41G 1/467 124/87
3,910,700 A 10/1975 Sprandel
4,011,853 A 3/1977 Fletcher
4,454,857 A 6/1984 Miller et al.
4,554,745 A 11/1985 Repa
4,563,821 A 1/1986 Saunders
4,625,420 A 12/1986 Figured
4,656,747 A 4/1987 Troncoso
4,656,994 A * 4/1987 Jenks ..... F41B 5/1415 124/23.1
4,833,786 A 5/1989 Shores, Sr.
4,858,589 A * 8/1989 Chang ..... F41B 5/143 124/24.1
4,860,458 A 8/1989 Ernstsen
4,895,129 A 1/1990 Hedgpeth
4,910,874 A * 3/1990 Busch ..... F41G 1/467 124/87
4,965,938 A 10/1990 Saunders
4,967,473 A 11/1990 Sherman
5,255,440 A 10/1993 Rogers
5,325,598 A 7/1994 Hall et al.
5,347,976 A 9/1994 Saunders
5,388,336 A 2/1995 Pomaville
5,450,673 A 9/1995 Denton
5,542,186 A 8/1996 Saunders
(Continued)

*Primary Examiner* — Christopher W Fulton
(74) *Attorney, Agent, or Firm* — Boyd D. Cox

(57) ABSTRACT

An adjustable peep sight for use with an archery bow that can be readily adjusted to allow multiple users each having different bowstring draw distances to aim accurately. The peep sight includes a slide element that is moveably mounted on a main body. The adjustable peep sight can be mounted on the bowstring of a bow and adjusted for various archers while the peep sight remains in the original position on the bowstring.

13 Claims, 5 Drawing Sheets

(56) References Cited

U.S. PATENT DOCUMENTS

| | | | | |
|---|---|---|---|---|
| 5,651,185 | A * | 7/1997 | Vanderheyden | F41G 1/467 124/87 |
| 5,669,146 | A | 9/1997 | Beutler | |
| 5,718,215 | A | 2/1998 | Kenny et al. | |
| 5,787,870 | A | 8/1998 | Summers et al. | |
| 5,893,356 | A | 4/1999 | Johns | |
| 6,058,921 | A * | 5/2000 | Lawrence | F41B 5/1419 124/87 |
| 6,170,164 | B1 | 1/2001 | Knowles | |
| 6,282,800 | B1 | 9/2001 | Beutler | |
| 6,418,633 | B1 * | 7/2002 | Rager | F41G 1/467 124/87 |
| 6,628,464 | B1 | 9/2003 | Johnson | |
| 6,796,039 | B2 | 9/2004 | Walbnnk | |
| 6,860,021 | B1 | 3/2005 | Connelly, III | |
| 6,981,329 | B1 | 1/2006 | Strathman | |
| 7,040,027 | B1 | 5/2006 | Shaffer et al. | |
| 7,047,652 | B1 | 5/2006 | Chipman | |
| 7,086,161 | B2 | 8/2006 | Ellig et al. | |
| 7,275,328 | B1 | 10/2007 | Rager | |
| 7,543,389 | B2 | 6/2009 | Grace, Jr. | |
| 7,543,390 | B2 | 6/2009 | Bach | |
| 7,574,811 | B2 | 8/2009 | Kurtzhals et al. | |
| 7,584,543 | B1 | 9/2009 | Boyd | |
| 7,621,055 | B1 | 11/2009 | Brooks | |
| 7,806,847 | B2 | 10/2010 | Behr | |
| 7,856,728 | B1 | 12/2010 | Ozinga | |
| 7,905,044 | B2 | 3/2011 | Clouser | |
| 8,015,744 | B1 | 9/2011 | Swan | |
| 8,186,094 | B2 | 5/2012 | AlKandari | |
| 8,225,517 | B2 | 7/2012 | Behr | |
| 8,276,282 | B2 | 10/2012 | Mainsonneuve et al. | |
| 8,281,777 | B2 | 10/2012 | Bach et al. | |
| 8,336,533 | B2 | 12/2012 | Bach et al. | |
| 8,453,336 | B2 | 6/2013 | LoRocco | |
| 8,544,180 | B2 | 10/2013 | Minica | |
| 8,619,238 | B2 | 12/2013 | Overstreet | |
| 8,863,433 | B2 | 10/2014 | Kruse | |
| 8,898,914 | B2 | 12/2014 | Bruder et al. | |
| 9,448,037 | B1 * | 9/2016 | Murphy | F41G 1/033 |
| 2007/0050998 | A1 * | 3/2007 | Myers | F41G 1/467 33/265 |

* cited by examiner

PEEP SIGHT FOR AN ARCHERY BOW

Priority for this application is claimed from U.S. Provisional Application No. 62/430,481 entitled "Peep Sight For An Archery Bow" filed on Dec. 6, 2016

BACKGROUND

The present invention is directed to a peep sight for use with an archery bow. The peep sight allows multiple users having different full draw distances to aim accurately without each individual user having to adjust the peep sight to a different location along the bowstring.

A peep sight is a rearwardly placed aiming device used in cooperation with a front sight on a bow. The peep sight can assist an archer in properly aligning and aiming the arrow with the target. The front sight on a bow is not necessarily accurate when used alone. When using only a front sight for aiming, the rear of the bow can unknowingly be positioned too low or too high for proper alignment of the arrow with the target causing the released arrow to miss the desired target. Typically, a peep sight is mounted on the bowstring above the arrow's nock and can assist in properly aligning the arrow with the front sight of a bow to ensure consistent accuracy for hitting the desired point.

In conventional use, an individual aims through the peep sight when the bowstring is fully drawn. The fully drawn length of the bowstring depends on the size and strength of the user and generally varies from one user to another. Therefore, the peep sight is attached to the bowstring at a particular location that is suited for the individual user in which the location is based on the bowstring draw length. Mounting a peep sight on a bowstring is a cumbersome task requiring skill and precision in order to be able to shoot the bow with accuracy. Since the location of the peep sight generally varies from user to user, the sight must be relocated for different users.

When bow sharing is desirable, it is often necessary to adjust the peep sight to suit individual users. Especially in archery classes having a limited number of bows, such may be the case. Since the location of the peep sight along the bowstring is dependent on a user's size and strength, the peep sight must be relocated along the bowstring to accommodate differing full draw lengths of its users.

Readjusting the location of a peep sight on the bowstring for different users can be a difficult and time-consuming task. Also, the inconvenience of having to perform such a task repeatedly during the course of a class can be a deterrent to archers. Therefore, there is a need for a peep sight that can be quickly adjusted for a different user so that many different users can easily and conveniently share the same bow.

In the present invention, the peep sight is itself adjustable so that once the peep sight is installed on the bowstring, a proper alignment for each individual can be obtained without having to move the peep sight along the length of the bowstring. This allows the users to share bows while avoiding the cumbersome and time-consuming task of relocating the peep sight on the bowstring. As a result, the peep sight can be passed to various users and quickly adjusted to suit the particular user's proper alignment for hitting the target.

SUMMARY

The present invention is drawn to a peep sight for mounting on a bowstring that can be quickly adjusted for multiple users having different draw lengths. The peep sight has a main body and an adjustable sighting means that can be adjusted to provide an accurate sight for users of varying size and strength.

BRIEF DESCRIPTION OF THE DRAWINGS

Reference is made to the accompanying drawings in which are shown illustrative embodiments of the invention and from which novel features and advantages will be apparent.

DETAILED DESCRIPTION

The present invention is a peep sight that is attached to a bow and is used for aiming an arrow. The peep sight is a rear sight that is typically mounted on the bowstring and used in cooperation with a front sight that is typically mounted on the bow. To aim an arrow, the user will sight the target through both the peep sight and the front sight.

Figure 1:
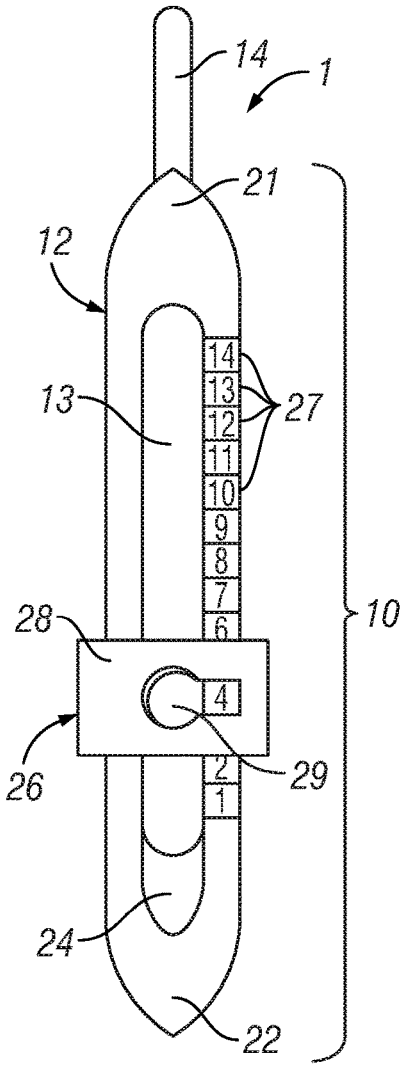
FIG. 1 is a front view of a first embodiment of the adjustable peep sight of the present invention.
Figure 2:
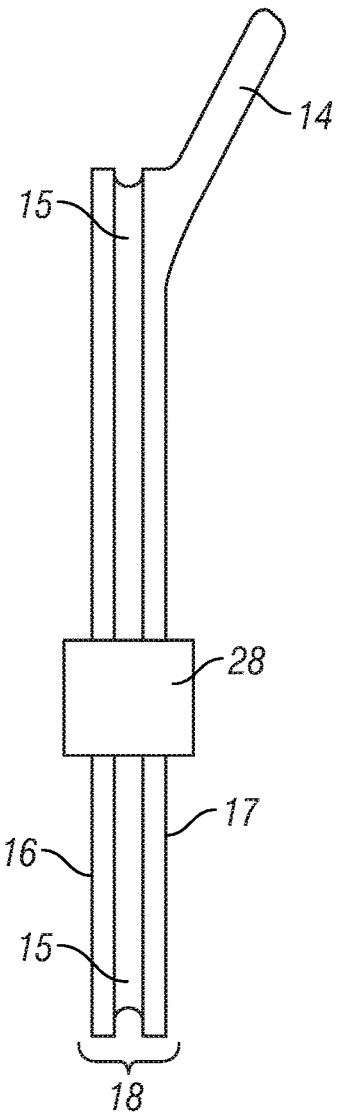
FIG. 2 is a side view of the first embodiment of the adjustable peep sight shown in FIG. 1.
Figure 3:
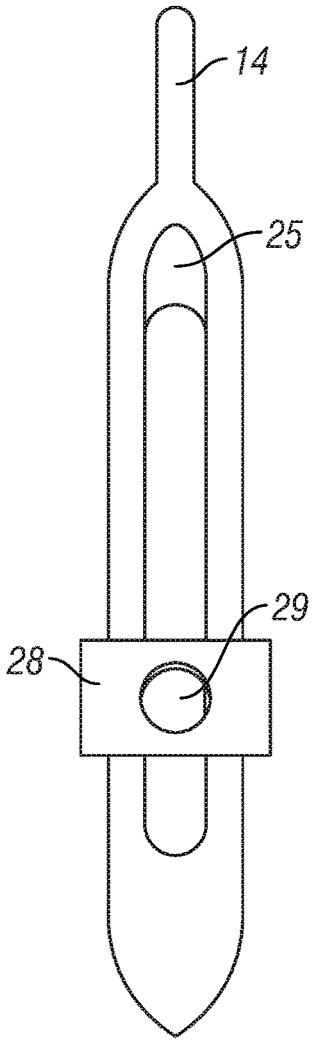
FIG. 3 is a back view of the first embodiment of the adjustable peep sight shown in FIG. 1.
Figure 4:
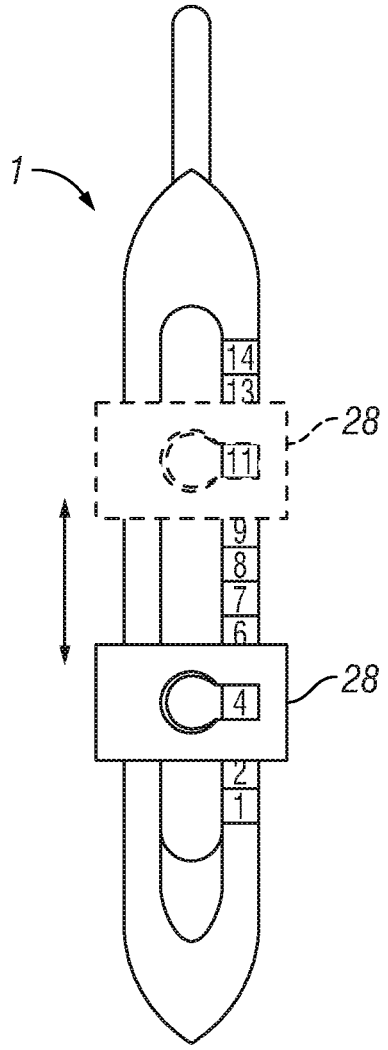
FIG. 4 is a front view of the peep sight shown in FIG. 1 with the slide element shown in dotted lines located in another position along the length of the main body.
Figure 5:
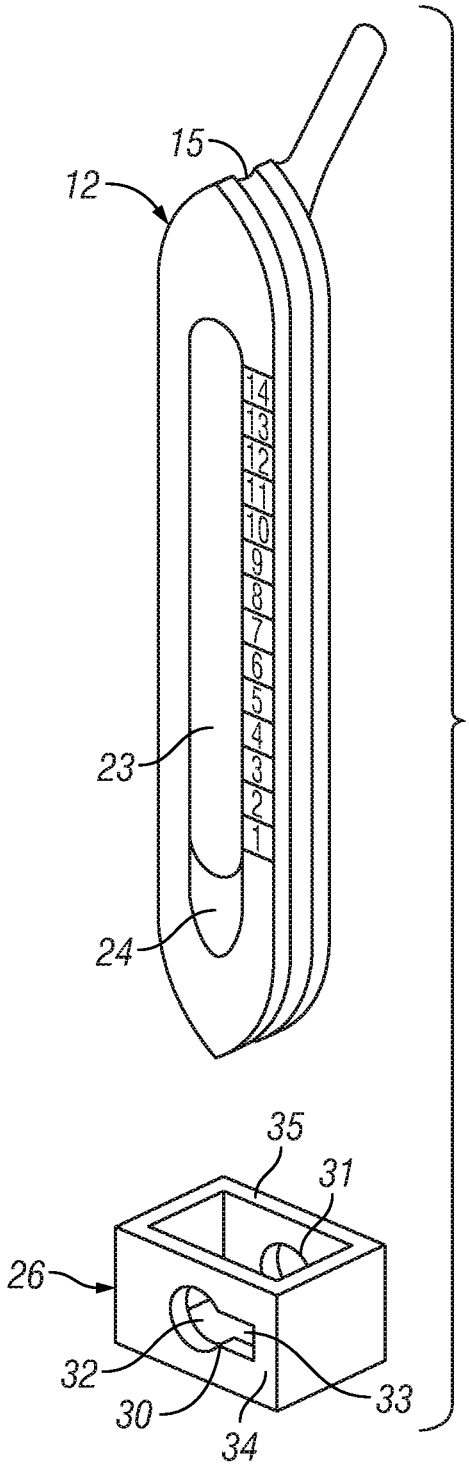
FIG. 5 is an exploded perspective view of the first embodiment of the adjustable peep sight shown in FIG. 1.

In a preferred first embodiment shown in FIGS. 1-5, the peep sight (1) is shown to comprise a main body (10) and an adjustable sighting means.

The main body (10) includes a housing (12) and a stabilizing arm (14).

The housing (12) comprises an opening (13) and means for attaching the peep sight to a bowstring. The housing is elongated with a length and width and is characterized by a front side (16), a back side (17), side edges (18) and interior walls (23). Additionally, the housing (12) has upper (21) and lower (22) ends, both of which are tapered. The means for attaching the peep sight to a bowstring are grooves (15) disposed on the side edges (18) of the housing (12).

The opening (13) is elongated and extends through the housing (12). The interior walls (23) surround the opening (13). The interior walls (23) have first (24) and second (25) beveled surfaces that are contiguous with the opening (13). The first (24) and second (25) beveled surfaces are disposed on the respective lower (22) and upper (21) ends of the housing (12).

The adjustable sighting means includes a slide element (26) and indicia markings (27). The indicia markings (27)

are located on the front side (16) of the housing (12) and extend along a side of the opening (13).

The slide element (26) comprises a collar (28) having a sight aperture (29). The collar (28) includes a front collar wall (34) and a back collar wall (35). The collar (28) encircles the housing and is slideable along the housing's length. Therefore, the collar (28) can be moved to various selected positions on the housing (12).

The sight aperture (29) comprises a front aperture (30) and a back aperture (31). The front aperture (30) is located on the front collar wall (34) and the back aperture (31) is located on the back collar wall (35) of the collar (28). The front (30) and back (31) apertures are generally aligned with each other and are also aligned with the opening (13) in the housing (12). This arrangement enables a user to look through the front aperture (30), the back aperture (31) and the opening (13) with a direct line of sight.

On the collar (28), the front aperture (30) includes a sighting portion (32) and a marking portion (33). The sighting portion (32) is disposed over the opening (13), thereby allowing the user to have a direct line of sight through the sighting portion (32), the opening (13) and the back aperture (31).

The marking portion (33) of the front aperture (30) is disposed over the indicia markings (27) so that a selected indicia marking (27) can be visible from a front side (16) of the housing (12) to indicate the position of the collar (28) on the housing (12). Consequently, a user can select the proper setting for the peep sight (1) by sliding the collar (28) along the housing (12) until the appropriate indicia marking (27) for that user is visible through the marking portion (33) of the front aperture (30).

On the main body (10), the grooves (15) are disposed on the side edges (18) of the housing (12) and extend around a perimeter of the housing (12). The grooves (15) are instrumental for installing and securing the peep sight (1) on the bow for use.

To install the peep sight (1), the bowstring is split and one part of the string is positioned in the groove (15) on one side of the housing (12) and the other part of the string is positioned in the groove (15) on the opposite side of the housing (12). With the bowstring surrounding the housing (12), the peep sight (1) is securely maintained in position for use.

The stabilizing arm (14) extends outwardly from the back side (17) of the housing (12). The stabilizing arm (14) deters twisting of the peep site (1) when the bowstring is drawn.

To adjust the peep sight (1) of the first preferred embodiment, the collar (28) is moved up or down on the housing (12) until the desired indicia marking (27) is visible through the front aperture (30) of the collar's sight aperture (29). When the desired indicia marking (27) is visible, the collar (28) is released to remain in that selected location.

Figure 6:
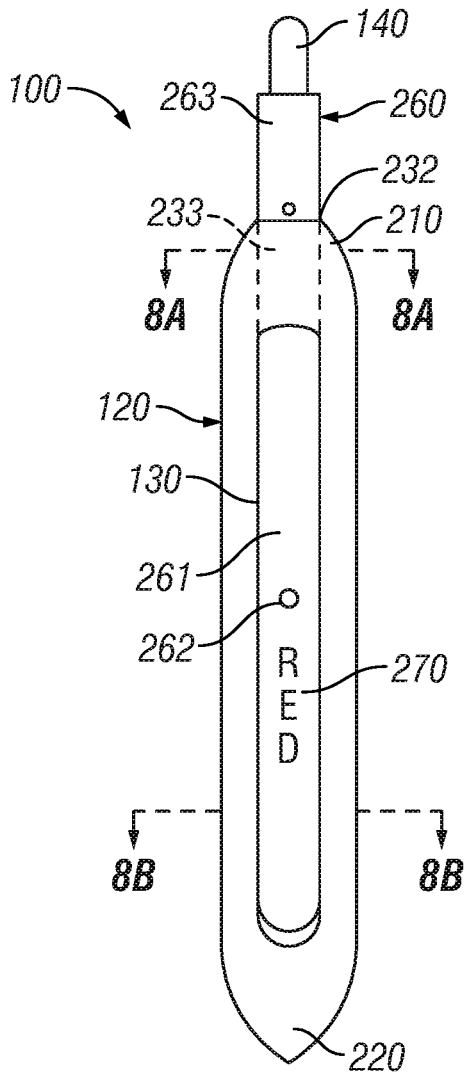
FIG. 6 is a front planar view of a second embodiment of the adjustable peep sight of the present invention.
Figure 7:
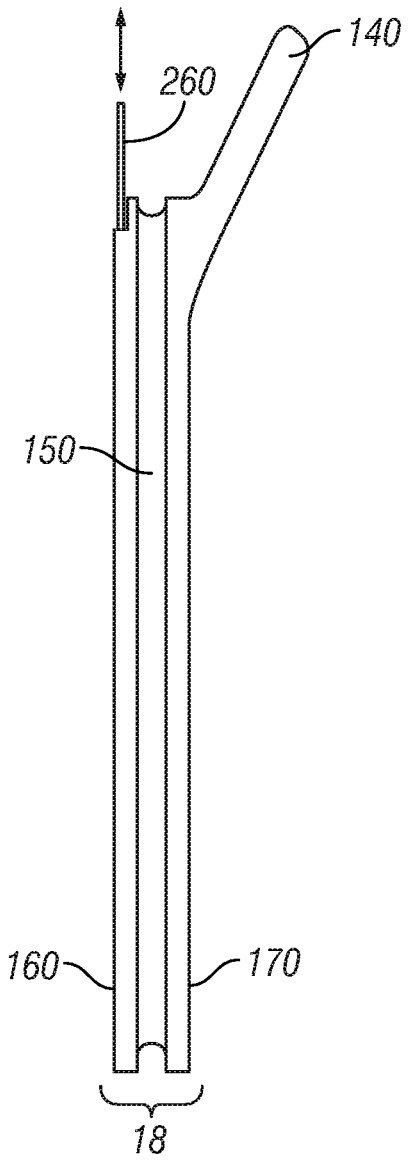
FIG. 7 is a side view of the second embodiment of the adjustable peep sight shown in FIG. 6.
Figure 8A:
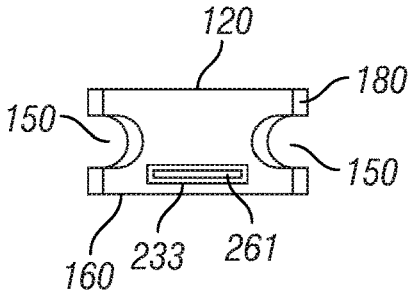
FIG. 8A is a cross sectional view of the second embodiment of the adjustable peep sight taken at line 8A-8A in FIG. 6.
Figure 8B:
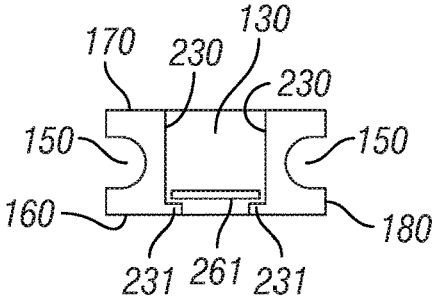
FIG. 8B is a cross sectional view of the second embodiment of the adjustable peep sight taken at line 8B-8B in FIG. 6.
Figure 9:
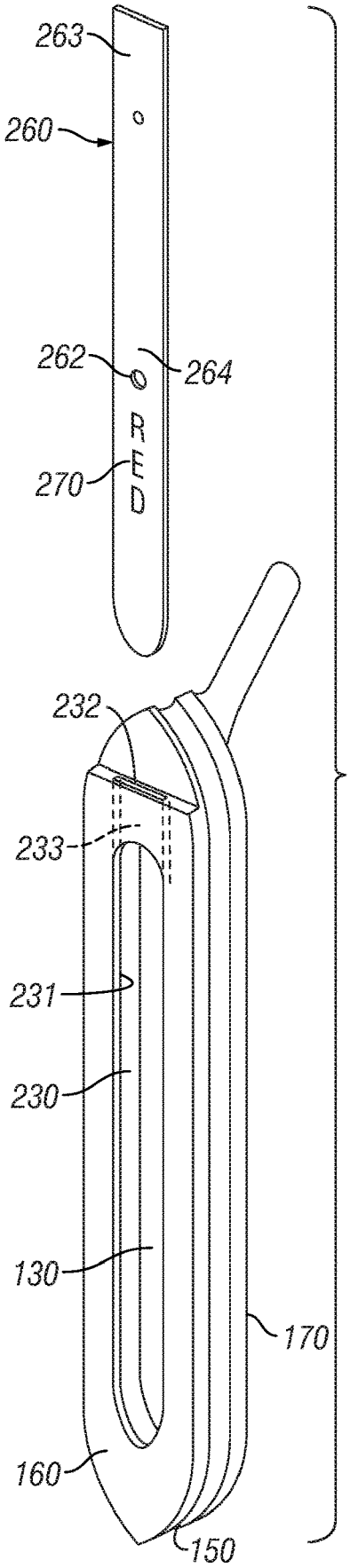
FIG. 9 is an exploded perspective view of the second embodiment of the adjustable peep sight shown in FIG. 6.
Figure 10:
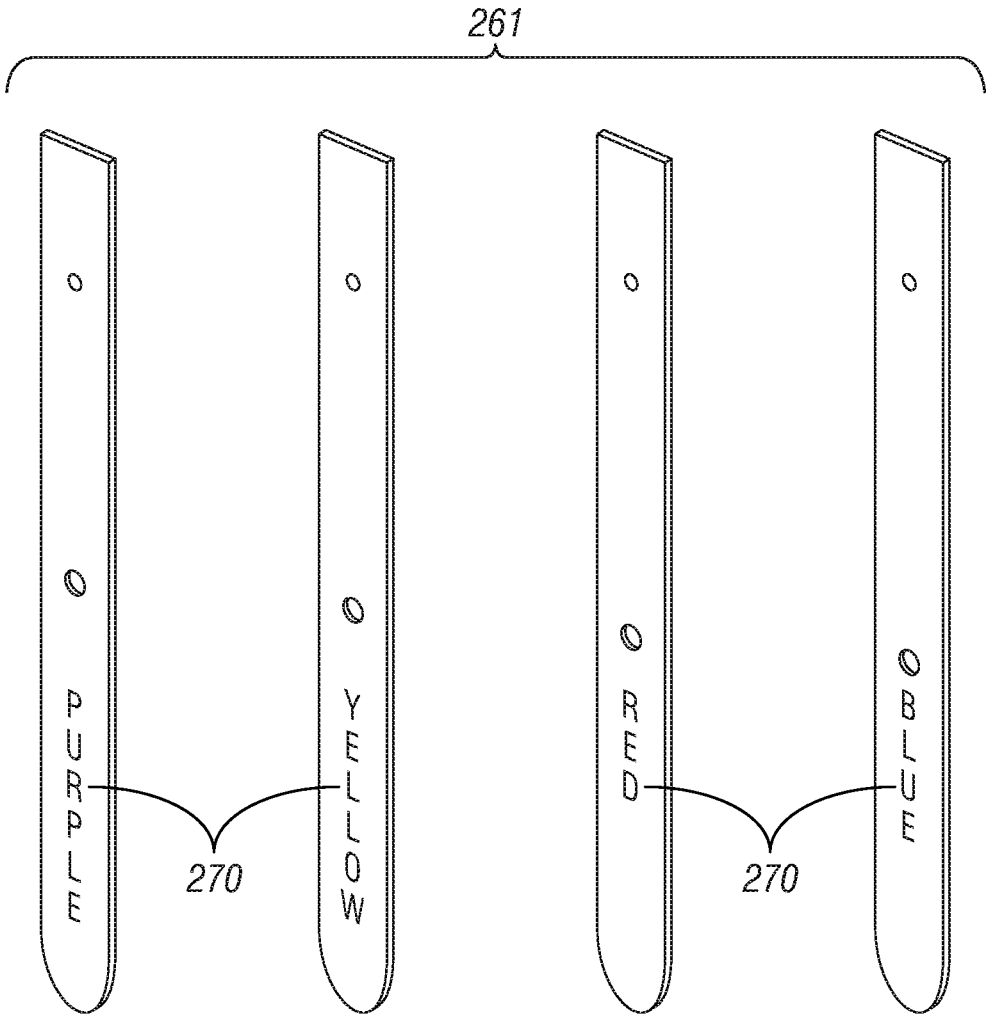
FIG. 10 is a perspective view of the plurality of interchangeable cards of the peep site of the second preferred embodiment shown in FIG. 6.

In a second preferred embodiment as shown in FIGS. 6-10, the peep sight (100) comprises a main body (110) and an adjustable sighting means.

The main body (110) includes a housing (120) and a stabilizing arm (140). The housing (120) of the second preferred embodiment includes an opening (130) and grooves (150). The housing is elongated and has a front side (160), a back side (170) and side edges (180). The housing (120) also includes an upper end (210) and a lower end (220). Both the upper (210) and lower (220) ends are tapered. A length and width further define the housing (120).

The opening (130) is elongated and extends through the housing (120) between the front (160) and back (170) walls. Interior walls (230) on the housing (120) surround the opening (130) and are further characterized by guides (231) positioned on each side of the opening (130).

The housing (120) further includes a portal (232) and body channel (233). The portal (232) is on the upper end (210) of the housing (120) and opens to the front side (160) of the housing (120). The body channel (233) extends from the portal (232), through the housing (120) and into the opening (130).

The stabilizing arm (140) extends outwardly from the back side (170) of the main body (110). The stabilizing arm (140) deters twisting of the peep sight (100) when the bow string is drawn.

In the second preferred embodiment, the adjustable sighting means is a slide element (260). The slide element (260) comprises a plurality of interchangeable cards (261). Each of the cards (261) is elongated and comprises a tab (263), a central portion (264), a sight aperture (262) and indicia marking (270).

A respective sight aperture (262) extends through the central portion (264) of each interchangeable card (261). Furthermore, each sight aperture (262) is positioned at a discrete location which coincides with a user's bowstring draw length. Since the positions of the sight apertures (262) are variable, the proper card (261) with the appropriate sight aperture (262) can be matched to the appropriate user.

The indicia marking (270) represents a particular location on the card (261) of the sight aperture (262). Therefore, the indicia marking (270) provides ready identification of the appropriate card (262) needed by each particular user.

Preferably, the indicia marking (270) may include a different color marked on each card to distinguish the different cards (261) and to identify a particular card. For example, a red card could be the identifying color for one user and a blue card could be the identifying color for another user with a different bowstring draw length. In another embodiment, indicia markings (270) could comprise written indicia such as numbers or letters to identify the appropriate card for an individual archer.

To use the peep sight (100) of the second preferred embodiment, a selected interchangeable card (261) having a bowstring draw length associated with a particular user is inserted into the housing (120) of the peep sight (100). The card (261) can then be replaced with an appropriate card (261) for each user having a different bowstring draw length.

The indicia marking (270) of each elongated interchangeable card (261) coincides with a discrete location of the sight aperture (262) on the card's central portion (264). The indicia marking (270) is used to identify the appropriate card for the particular user. The elongated cards (261) are interchangeable with each other so that any of the cards (261) can easily be inserted into the housing (120) of the peep site (100), if desired.

When one of interchangeable cards (261) is disposed within the main body (110), the card (261) extends into the portal (232), through the channel (233), and into the opening (130) of the housing (120). The guides (231) on the interior walls (230) of the housing (120) receive edges of the elongated card (261) and hold the card (261) in place within the opening (130). The guides (231) are also adapted to direct a respective elongated card (261) into the opening (120) as the card (261) is being inserted into the housing (120).

The tab (263) is located on one end of the elongated interchangeable card (261) and is generally outside of the housing (120) when one of the cards (261) is positioned for use in the main body (110). The tab (263) is adapted for grasping in order to manually manipulate the elongated card (261). Consequently, the card (261) can readily be inserted into the housing (120) and pulled out of the housing (120) when replacement is required.

The grooves (150) of the main body (110) are positioned on the side edges (180) of the housing (120) and extend around the housing (120). The grooves (150) are adapted to receive the bowstring of the bow when the peep sight (100) is installed on the bow.

To install the second preferred embodiment peep sight (100) on a bow, the bowstring is split and one part of the string is positioned in the groove (150) on one side of the housing (120) and the other part of the string is positioned in the groove (150) on the opposite side of the housing (120). With this arrangement, the bowstring substantially surrounds the housing (120) and secures the peep sight (100) in place for use on the bow.

To adjust the peep sight (100) of the second preferred embodiment, a card (261) positioned in the housing is replaced by another card (261) having a different indicia marking (270). To replace the card (261) positioned in the housing (120), that card (261) is first removed from the main body (110). The tab (263) is used to grasp the card (261) and slide the card (261) out of the housing (120) by a pulling motion. When that card (261) is completely removed, the replacement card (261) can be inserted. To insert, the selected replacement card (261) is grasped by its tab (263) and inserted into the housing (120) beginning with insertion of the end of the card (261) opposite the tab (263) into the portal (232). The card (261) is pushed through the portal (232) and into the channel (233) until the central portion (264) is disposed within the opening (130) and the card (261) will slide no farther inwardly.

Preferably, the housing of the peep sight (1, 100) can be made of various materials including polymer materials, plastic, composite, wood, carbon fiber or metal. However, other suitable materials could be used instead of those listed herein. The card (261) is made from a sheet of durable material such as stiff paper, cardboard, plastic or other suitable material.

The peep sight of the present invention can be quickly and easily adjusted for different users whose bowstring draw lengths may vary. Consequently, a number of users can share the same bow while maintaining shooting accuracy.

Although the present invention has been described in considerable detail with reference to certain preferred versions thereof, other versions are possible. Therefore, the spirit and scope of the appended claims should not be limited to the description of the preferred versions contained herein.

The invention claimed is:

1. An adjustable peep sight for mounting on a bowstring of an archery bow, wherein the peep sight can be readily adjusted for various users having different bowstring draw lengths, said adjustable peep sight comprising;

a main body; and an adjustable sighting means;

said main body comprises a housing;

said housing includes a length, front and back sides, and side edges, wherein said side edges adjoin said front and back sides of the housing;

said housing further comprises an elongated opening and means for attaching the peep sight to a bowstring, wherein the elongated opening extends through the housing;

said adjustable sighting means includes at least one slide element, wherein said at least one slide element is moveably mounted on the housing of said main body to selectively adjust the peep sight to accommodate users having different bowstring draw lengths;

said at least one slide element comprises a plurality of interchangeable cards;

each of said interchangeable cards comprises a sight aperture;

wherein each of said sight apertures is disposed at a discrete location on respective interchangeable cards; and wherein each of said sight apertures is aligned with the elongated opening on said housing, and wherein a line of sight extends through both the sight aperture and the opening.

2. The adjustable peep sight of claim 1, wherein each of said interchangeable cards further comprises an indicia marking, wherein the indicia marking on each interchangeable card identifies the discrete location of the sight aperture for the respective interchangeable card.

3. The adjustable peep sight of claim 2, wherein a selected one of said interchangeable cards is disposed within the housing, whereby the interchangeable card extends into the opening of the housing.

4. The adjustable peep sight of claim 3, wherein to adjust the peep sight for a different bowstring draw length, the interchangeable card positioned within the housing is removed from the peep sight, and another interchangeable card is inserted into the housing.

5. The adjustable peep sight of claim 4, wherein said housing further comprises upper and lower ends, a channel, and a portal, wherein said portal is disposed on the upper end of the housing and said channel extends between said portal and said opening.

6. The adjustable peep sight of claim 5, wherein said housing further comprises interior walls and a guide, wherein said interior walls extend around a perimeter of the elongated opening and said guide is disposed on said interior walls and secures the interchangeable card within the opening of the housing.

7. The adjustable peep sight of claim 4, wherein each of said interchangeable cards further comprises a central portion and a tab, wherein said tab is attached to the central portion and is adapted for manipulating said interchangeable card, and said sight aperture is disposed on the central portion.

8. The adjustable peep sight of claim 7, wherein to replace the interchangeable card of the peep sight, the interchangeable card positioned in the housing is removed by grasping and pulling the tab to thereby slide the interchangeable card out of the housing; and the selected interchangeable card is then inserted into the housing by grasping the respective tab and inserting the card into the portal, through the channel and into the opening of the housing.

9. The adjustable peep sight of claim 4, wherein said means for attaching the peep sight to a bowstring comprises grooves, wherein said grooves are disposed in the side edges of the housing and receive the bowstring therein when the peep sight is installed on a bow.

10. The adjustable peep sight of claim 2, wherein said indicia marking on each of said interchangeable cards comprises a color, wherein the color corresponds to the discrete location of the sight aperture on the respective interchangeable card.

11. The adjustable peep sight of claim 2, wherein said indicia marking on each of said interchangeable cards comprises at least one letter, wherein the at least one letter corresponds to the discrete location of the sight aperture on the respective interchangeable card.

12. The adjustable peep sight of claim 2, wherein said indicia marking on each of said interchangeable cards comprises at least one number, wherein the at least one number corresponds to the discrete location of the sight aperture on the respective interchangeable card.

13. An adjustable peep sight for mounting on a bowstring of an archery bow, wherein the peep sight can be readily adjusted for various users having different bowstring draw lengths, said adjustable peep sight comprising:

a main body; and an adjustable sighting means, wherein said adjustable sighting means is moveably mounted on said main body;

said adjustable sighting means comprises at least one slide element;

said at least one slide element comprises a plurality of interchangeable cards; wherein said interchangeable cards are adapted to be removably mounted on the housing to selectively adjust the peep sight for different bowstring draw lengths;

each of said interchangeable cards includes a central portion, a tab, and a sight aperture; a respective sight aperture is disposed at a discrete location on each of said interchangeable cards;

wherein said tab is adapted for manipulating said interchangeable card, and said marking indicia identifies the respective discrete location of the sight aperture for each respective interchangeable card;

said main body comprises a housing having front and back sides, side edges, and a stabilizing arm, wherein said side edges adjoin said front and back sides of the housing, and said stabilizing arm extends outwardly from the back side of the housing;

said housing is elongated and includes a length, a width, and upper and lower ends;

said housing further comprises an elongated opening and grooves for attaching the peep sight to a bowstring, wherein the elongated opening extends through the housing, and said grooves are disposed on the side edges;

said housing further includes interior walls, a channel, a portal and a guide; wherein said interior walls extend around a perimeter of the elongate opening, the portal is disposed on the upper end of the housing, and said channel extends within the housing between said opening and said portal;

wherein said guide is disposed on said interior walls of the opening and secures said interchangeable cards within the opening of the housing;

wherein said sight apertures on respective interchangeable cards align with the opening on said main body so that a sight line extends through the respective sight apertures and the opening;

wherein to insert another card into the housing, the tab is grasped and an opposite end of the card is inserted into the portal, slid through the channel and into the elongated opening;

wherein to remove an interchangeable card from the housing, the tab on the respective card is grasped and pulled to slide the card outwardly through the portal; and wherein to adjust the peep sight for a user with a different bowstring draw length than a prior user, the interchangeable card positioned within the housing for the prior user is removed from the peep sight and another interchangeable card appropriate for the user with the different bowstring draw length is inserted into the housing.

* * * * *